US005802836A

United States Patent [19]

Curran et al.

[11] Patent Number: 5,802,836

[45] **Date of Patent: *Sep. 8, 1998**

[54] METHOD FOR MAKING THREAD USING SUBSTANTIALLY EQUAL OVERFEED TO AN INTERMINGLING DEVICE

[75] Inventors: William Wingate Curran; John Aitken, both of Paisley, Great Britain

[73] Assignee: J. & P. Coats, Limited, Glasgow, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 640,932

[22] PCT Filed: Nov. 8, 1994

[86] PCT No.: PCT/GB94/02455

§ 371 Date: Jul. 8, 1996

§ 102(e) Date: Jul. 8, 1996

[87] PCT Pub. No.: WO95/14124

PCT Pub. Date: May 26, 1995

[30] Foreign Application Priority Data

Nov. 13, 1993 [GB] United Kingdom ..... 9323441

[51] Int. Cl.[6] ..... D01H 13/26

[52] U.S. Cl. ..... 57/351; 28/220; 28/271; 57/289; 57/290; 57/908

[58] Field of Search ..... 57/285, 290, 289, 57/284, 208, 351, 350, 908; 28/271, 220, 240

[56] References Cited

U.S. PATENT DOCUMENTS

| | | | |
|---|---|---|---|
| 3,199,281 | 8/1965 | Maerov et al. | 57/140 |
| 4,280,261 | 7/1981 | Nelson | 28/271 |
| 4,311,000 | 1/1982 | London et al. | 28/258 |
| 4,319,447 | 3/1982 | Barron | 28/271 |
| 4,437,301 | 3/1984 | Eschenbach et al. | 57/289 |
| 4,574,578 | 3/1986 | Scott | 57/208 |
| 4,610,131 | 9/1986 | Eschenbach et al. | 57/208 |
| 4,934,134 | 6/1990 | Niederer | 57/350 |
| 5,307,616 | 5/1994 | Goineau et al. | 57/284 |
| 5,379,501 | 1/1995 | Goineau | 28/271 |
| 5,459,991 | 10/1995 | Nabeshima et al. | 57/284 |

FOREIGN PATENT DOCUMENTS

| | | |
|---|---|---|
| 37118 | 10/1981 | European Pat. Off. . |
| 57583 | 1/1982 | European Pat. Off. . |
| 119044 | 9/1984 | European Pat. Off. . |
| 2166168 | 4/1986 | United Kingdom . |
| 94/10362 | 5/1994 | WIPO . |

*Primary Examiner*—William Stryjewski
*Attorney, Agent, or Firm*—Kenneth C. Hill

[57] ABSTRACT

A method of making yarn comprises feeding at least two drawn, continuous filament starting yarns (18, 19), of which at least one is a multifilament yarn, together to an intermingling device (21) to form a single bulked thread of which the filaments of the starting yarns are intermingled and looped, and applying a bulk-reducing treatment to the bulked thread (27), characterized in that the starting yarns are fed to the intermingling device with substantially equal overfeed.

36 Claims, 1 Drawing Sheet

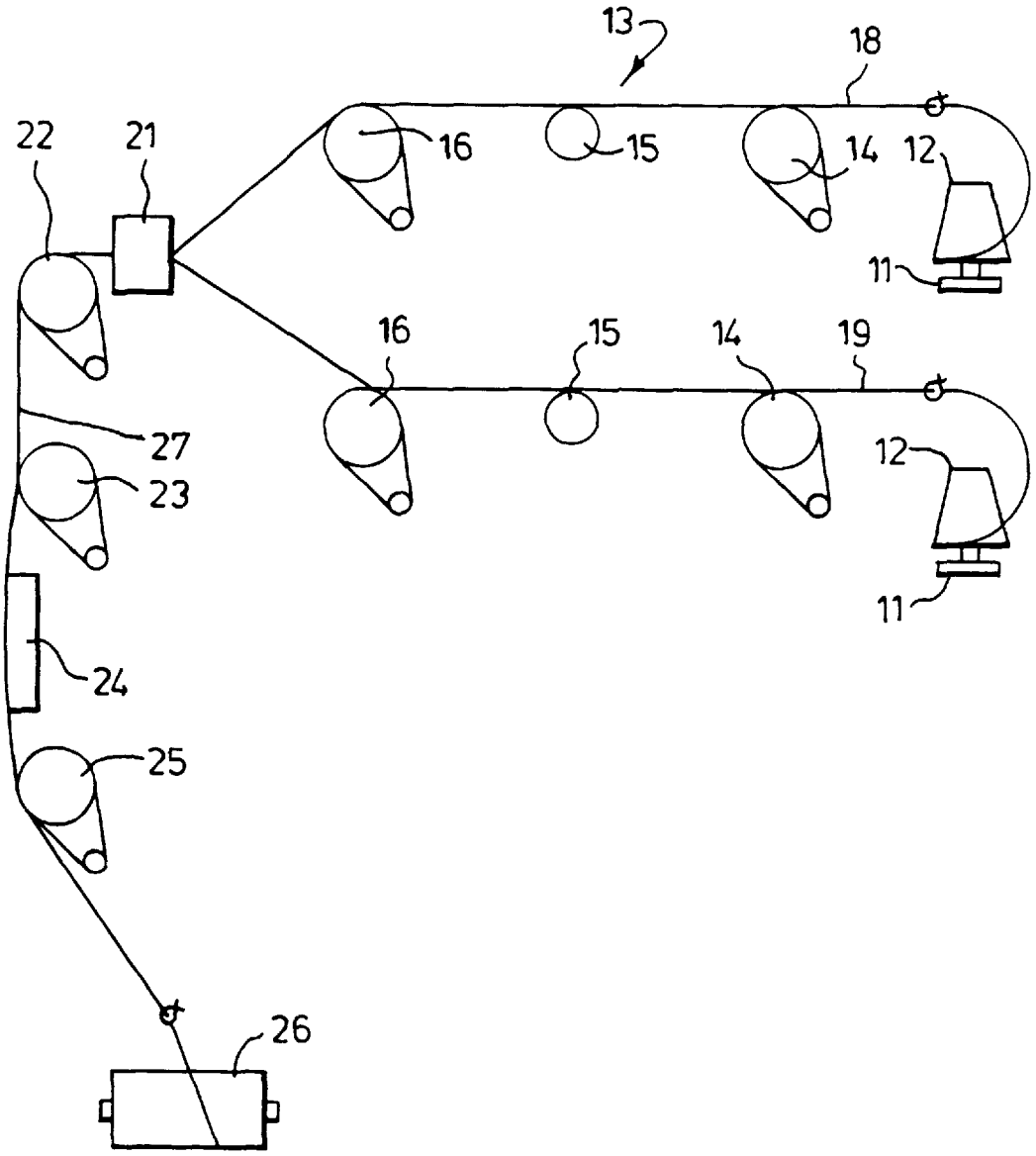
13
18
22
21
16
15
14
12
11
16
15
14
19
27
23
12
11
24
25
26

METHOD FOR MAKING THREAD USING SUBSTANTIALLY EQUAL OVERFEED TO AN INTERMINGLING DEVICE

FIELD OF THE INVENTION

This invention relates to methods of making thread.

1. Background Information

2. Description of Related Art

EP-0 057 583 discloses a method for making a textile strand involving differentially overfeeding two separate filamentous strands to a jet device which commingles and interlaces and forms loops in the filaments of the strands and then subjecting the commingled strand to a heating step in which loops formed by the jet are pulled and in so doing tighten any entanglements present as a result of the jet treatment and thus consolidate the strand. A "twistless" sewing thread can be produced in this way, "twistless" implying not that the thread is without twist, because twist can always be added, but rather that the thread has been produced without the need for twisting which is implicit in the production of sewing thread from staple fibre such as cotton.

In addition to the savings produced by avoiding the need to insert high twist levels, the method of EP-0 057 583 allows the use of low cost starting materials in the form of partially oriented yarn (POY) for instance of polyester that are in plentiful supply, in order to produce high-value sewing threads, for example. The sewing threads thereby produced have excellent properties in sewing.

The method of EP-0 057 583 involves feeding at least two strands to an intermingling device (in the form of a texturing jet) at different rates of overfeed so that loops form on the strands thus creating an intermingled textured yarn which is subsequently heat treated to eliminate the bulkiness of the yarn.

It has now been found that the method of EP-0 057 583 can be modified to yield further cost savings and/or other advantages over the prior art methods of sewing thread production, which modifications will also be useful in connection with other yams that can be produced by the process of EP-0 057 583 and indeed in extending the range of yarns which can be produced using that method.

SUMMARY OF THE INVENTION

The invention comprises a method for making a thread comprising:

feeding at least two drawn, continuous filament starting yams, of which at least one is a multifilament yarn, together to an inter mingling device to form a single bulked thread of which the filaments of the starting yarns are intermingled and looped, and applying a bulk-reducing treatment to the bulked thread, characterised in that the starting yarns are fed to the intermingling device with substantially equal overfeed.

The starting yarns may comprise yarns having substantially different behaviour under heat and/or tension treatment and may, as in EP-0 057 583, comprise a "core" yarn and an "effect" yarn, the core being present to provide the strength and stability of the finished thread and the effect yarn being present to bind the filaments together. The core yarn will then comprise a major proportion of the thread and is desirably a high tenacity yarn. Again in accordance with EP-0 057 583, the high tenacity yarn (at least) may be produced by overdrawing a POY.

Depending on the linear density and/or tenacity of the required thread, further savings and improvements can be made by starting with two identical yarns—this will result in a saving on inventory costs, since only one yam need to be stocked, and it will almost always be more economical to make a thread out of two identical starting yams than out of two dissimilar yarns. Depending, again, on the properties required in the thread, it may be possible to treat the two yarns identically or differentially. If they have identical treatment, the distinction between core and effect disappears, of course, or each can be regarded as an effect yarn for the other, binding its filaments together as a result of the bulk-reducing treatment, and each can be regarded as a core, contributing strength to the thread. Again, the POY threads can be overdrawn to provide increased strength over the same yarn when normally processed, for example, for making textured knitting yam.

Identical starting yarns may however be differentially treated en route to the intermingling device, as by differential drawing for example. Thus one POY which would have a normal draw ratio of 1.7:1 could be drawn with a draw ratio of 2.2:1 and the other with a draw ratio of 1.85:1; the latter would then behave more as an effect yarn, binding in the filaments of the more overdrawn core yarn, the latter contributing more to the overall tenacity of the finished thread. Another differential effect could be produced by cold drawing one starting yarn and hot drawing the other.

In any event, the drawing can be a continuous operation, effected en route to the intermingling device, for either or both starting yarns, or, if found more convenient, in a separate operation so that at least one of the starting yarns is drawn yarn from package.

The bulk reducing treatment may comprise a tension-applying treatment, which may comprise an underfeeding operation, which may be effected without heat. Or, as described in EP-0 057 583, the tension applying treatment may comprise a heat treatment generating a tension in an overfeeding (down to zero overfeed) operation or adding to tension in an underfeeding operation. The heat may be applied by a hot roller (which may be a roller of an underfeeding or overfeeding arrangement) or between under or overfeeding rollers, as by a hot plate or hot air heater.

BRIEF DESCRIPTION OF THE DRAWING

Methods for making threads according to the invention will now be described with reference to the accompanying drawing, in which the single Figure is a diagrammatic illustration of an apparatus for producing thread.

DETAILED DESCRIPTION OF THE INVENTION

The apparatus illustrated in the Figure comprises supports 11 for a pair of yarn supply packages 12 and for each support 11 a drawing arrangement 13 comprising a first godet 14, a heatable draw pin 15 and a second, heatable godet 16.

The two starting yarns 18,19 are fed to an air jet intermingling device 21 such as a Heberlein T300 series or a Du Pont Mk XV jet.

The intermingled, bulked thread is withdrawn from the jet 21 by a godet 22 and passes to a heatable godet 23, thence over a plate heater 24 (for which a hot air tube heater or other such device could be substituted) to a final godet 25, which forwards it to a wind-up package 26.

It is to be understood that the arrangement thus described is a comprehensive arrangement, individual items of which may be by-passed (and, in an industrial operation, therefore, omitted altogether to simplify the machinery and keep its capital cost as low as possible) or, in the case of heatable components such as draw pins and godets, left unheated (so that, again, for an industrial operation, an unheated version of the component would be used).

Further, it should be understood that suitable drive means will be used allowing the various rolling components to be driven at any desired speed (though again such provision for variable speed need not be carried through to an industrial machine intended to make one specification of thread only) and suitable temperature control means will be available for the heated components.

The apparatus facilitates various methods of thread production within the scope of the invention, namely by feeding at least two drawn, continuous filament starting yarns 18,19 together to the intermingling device 21 to form a single bulked thread 27 of which the filaments of the starting yams 18,19 are intermingled and looped, and applying, between godets 22 and 25, a bulk-reducing treatment to the thread 27, the starting yarns 18,19 being fed to the intermingling device 21 with substantially equal overfeed. This latter requirement is effected by the godets 16 before the jet 21 running at equal feed speeds, greater than the speed of the godet 22 downstream of the jet 21.

A typical overfeed here could be from about 4.5% to about 30%, being the percentage excess of speed of the godets 16 over that of godet 21. The excess yam fed into the air jet 21 is accommodated in loops in the filaments of the bulked thread 27, and the amount of overfeed will be determined in accordance with the properties of the jet 21 and the desired properties of the finished thread.

The concept of the core and effect yarn components described in EP-0 057 583 may be maintained by selecting two different threads as starting yams.

Two typical yarns may be a core yarn drawn from a 312 F48 POY polyester yarn and an effect yarn drawn from an 80 F 24 such yam. It is possible to have three or more starting yams, of course, and one starting yarn could even be a monofilament, though when there are only two yams it is unlikely that if one of them were indeed a monofilament the resulting thread would be useful for many end purposes.

A 312 F 48 POY polyester yarn would be drawn in the drawing arrangement 13 at a draw ratio higher than the normal draw ratio for such yarn. Such a yarn would have a normal draw ratio of about 1.7:1, but it is possible to overdraw such yarn for example at a ratio of 2.2:1 resulting in a high tenacity yarn.

The 80 F 24 effect yarn could be overdrawn to a lesser extent, say to a ratio of 1.83:1, rather than the 1.7:1 which would be normal.

As already mentioned, the starting yarns 18,19 can comprise identical yarns, which may be differentially treated en route to the air jet 21. For example, identical yarns with a normal draw ratio of 1.7:1 could be used, one being overdrawn at a ratio of 2.2:1, the other at a ratio of 1.83:1. Or one may be hot drawn, the other cold drawn. They may, however, be treated identically in all respects, as by being drawn at a ratio of 2.14:1, and fed at an overfeed of 10% to the jet 21.

The post-jet treatment is aimed at eliminating or reducing the bulk produced by the air jet 21 whilst retaining the intermingled structure that brought about their bulk, essentially reducing the size of the filament loops so that the thread becomes an essentially unbulked thread which is cohesive in the sense that its filaments do not tend to fly apart and which to all intents and purposes can be used as spun thread (after such finishing treatments as are appropriate, which may include the application of a lubricant and the insertion of twist, the latter being required for some purposes at a much lower level than for conventionally spun thread, rather as a means of helping to maintain an essentially circular cross-section when the thread is running over an edge or surface as in sewing).

The bulk-reducing treatment may comprise the application of heat as by hot godet 23 and/or hot plate 24 while the thread 27 is overfed or underfed between the godets 22 and 23 or 23 and 25, the heat causing the filaments of the thread to be tensioned by their tendency to shrink and in so doing reducing the size of any loops projecting from the thread and tightening in the filaments which, as effect yarn, are wrapped around the core yarn filaments binding them together.

As mentioned, variations can be made to the method and to the apparatus for the production of specific types of thread, starting from different raw materials. In particular, sewing threads having excellent properties both as to tenacity and as to low occurrence of breaks in normal and multidirectional sewing can be produced at a substantially lower cost than spun threads conventionally used for sewing.

We claim:

1. A method for making a thread from at least two drawn, continuous filament starting yarns, of which at least one is a multifilament yarn, the method comprising the steps of:

feeding all of the starting yarns together to an intermingling device, each of the starting yarns being fed with substantially equal overfeed, to form a single bulked thread of which the filaments of the starting yarns are intermingled and looped; and applying a bulk-reducing treatment to the bulked thread.

2. A method according to claim 1, in which the starting yarns comprise yarns having substantially different behavior under heat treatment.

3. A method according to claim 1, in which the starting yarns comprise yarns having substantially different behavior under tension treatment.

4. A method according to claim 1, in which the starting yarns comprise a core yarn and an effect yarn.

5. A method according to claim 4, in which the core yarn comprises a major proportion of the thread.

6. A method according to claim 5, in which the core yarn is a high-tenacity yarn.

7. A method according to claim 6, in which the high-tenacity yarn comprises an overdrawn yarn.

8. A method according to claim 4, in which the effect yarn has a lower heat shrinkage than the core yarn.

9. A method according to claim 4, in which the core yarn has a lower extensibility under load than the effect yarn.

10. A method according to claim 1, in which the starting yarns comprise two identical yarns.

11. A method according to claim 1, in which at least one of the starting yarns is drawn continuously with its being fed to the intermingling device.

12. A method according to claim 1, in which the bulk-reducing treatment comprises a tension-applying treatment.

13. A method according to claim 12, in which the tension-applying treatment comprises an underfeeding operation.

14. A method according to claim 12, in which the tension-applying treatment comprises a heat treatment that generates a tension in an overfeeding operation.

15. A method according to claim 14, in which heat is applied by a hot roller.

16. A method according to claim 15, in which the hot roller is a roller of an underfeeding or overfeeding arrangement.

17. A method according to claim 14, in which heat is applied between under- or overfeeding rollers.

18. A method according to claim 12, in which the tension-applying treatment comprises an underfeeding operation.

19. A method according to claim 12, in which the tension-applying treatment comprises a heat treatment adding to tension in an underfeeding operation.

20. A method for making a thread from a plurality of drawn, continuous filament starting yarns, of which at least one is a multifilament yarn, the method comprising the steps of:

overfeeding at substantially equal rates each of the starting yarns together to an intermingling device to form a single bulked thread of which the filaments of the starting yarns are intermingled; and reducing the bulk of the bulked thread.

21. A method according to claim 20, in which the starting yarns comprise yarns having substantially different behavior under heat treatment.

22. A method according to claim 20, in which the starting yarns comprise yarns having substantially different behavior under tension treatment.

23. A method according to claim 20, in which the starting yarns comprise a core yarn and an effect yarn.

24. A method according to claim 23, in which the core yarn comprises a major proportion of the yarn.

25. A method according to claim 23, in which the core yarn is a high-tenacity yarn.

26. A method according to claim 25, in which the high-tenacity yarn comprises an overdrawn yarn.

27. A method according to claim 23, in which the effect yarn has a lower heat shrinkage than the core yarn.

28. A method according to claim 23, in which the core yarn has a lower extensibility under load than the effect yarn.

29. A method according to claim 20, in which the starting yarns comprise two identical yarns.

30. A method according to claim 20, in which at least one of the starting yarns is drawn continuously with its being fed to the intermingling device.

31. A method according to claim 20, in which the bulk-reducing treatment comprises a tension-applying treatment.

32. A method according to claim 31, in which the tension-applying treatment comprises a heat treatment that generates a tension in an overfeeding operation.

33. A method according to claim 32, in which heat is applied by a hot roller.

34. A method according to claim 33, in which the hot roller is a roller of an underfeeding or overfeeding arrangement.

35. A method according to claim 34, in which heat is applied between under- or overfeeding rollers.

36. A method according to claim 31, in which the tension-applying treatment comprises a heat treatment adding to tension in an underfeeding operation.

* * * * *